12/3/85 XR 4,556,855

United States Patent [19]

Chiang et al.

[11] Patent Number: 4,556,855

[45] Date of Patent: Dec. 3, 1985

[54] RF COMPONENTS AND NETWORKS IN SHAPED DIELECTRICS

[75] Inventors: Bing Chiang, Beltsville, Md.; Boris Sheleg, Alexandria, Va.

[73] Assignee: The United States of America as represented by the Secretary of the Navy, Washington, D.C.

[21] Appl. No.: 547,511

[22] Filed: Oct. 31, 1983

[51] Int. Cl.[4] ..... H01P 5/18

[52] U.S. Cl. ..... 333/113; 333/248; 350/96.15

[58] Field of Search ..... 333/113, 114, 122, 239, 333/240, 248; 350/96.3, 96.15

[56] References Cited

U.S. PATENT DOCUMENTS

| | | | |
|---|---|---|---|
| 2,794,959 | 6/1957 | Fox | 333/113 |
| 2,829,351 | 4/1958 | Fox | 333/239 |
| 3,703,690 | 11/1972 | Ravenscroft et al. . | |
| 4,028,643 | 6/1977 | Itoh . | |
| 4,087,156 | 5/1978 | Kao et al. | 350/96.15 X |
| 4,091,343 | 5/1978 | Knox et al. . | |
| 4,240,694 | 12/1980 | Pan | 350/96.15 X |
| 4,287,495 | 9/1981 | Lund, Jr. et al. . | |
| 4,392,712 | 7/1983 | Ozeki | 350/96.15 X |

*Primary Examiner*—Paul Gensler
*Assistant Examiner*—Benny T. Lee
*Attorney, Agent, or Firm*—Robert F. Beers; William T. Ellis

[57] ABSTRACT

A new class of low cost microwave/millimeter wave dielectric couplers are disclosed. In one embodiment, the waveguides to be coupled are formed of bundles of dielectric fibers and coupling is achieved by having a certain percentage of the dielectric fibers crossover between the waveguide bundles. In a second embodiment, the waveguides are formed of stacked longitudinal dielectric lamination sheets and coupling is achieved by crossing over a certain number of the laminate sheets from one waveguide stack to the other waveguide stack.

13 Claims, 13 Drawing Figures

PRIOR ART

E
F
C
D
COUPLERS
COUPLERS
A
B
G
H

RF COMPONENTS AND NETWORKS IN SHAPED DIELECTRICS

BACKGROUND OF THE INVENTION

The present invention relates generally to the field of microwave/millimeter wave couplers, and more particularly to waveguide couplers for dielectric waveguides.

Conventional microwave circuits utilize rectangular metal waveguides, or stripline or microstrip conductors. However, for applications requiring higher frequencies near and in the millimeter wave range, the fabrication cost and/or the circuit power loss become prohibitive. The fabrication costs increase because the stripline and microstrip length dimensions must be proportional to the millimeter wavelengths they are propagating. The increased power loss occurs because the skin depth for the current flow decreases with increasing frequency thus causing a significant resistance increase in the line.

Accordingly, dielectric waveguides become an attractive alternative. However, such dielectric waveguides and the couplers used therewith still require machining, and the fabrication process is tedious and time-consuming. The machining referred to is required because prior art dielectric waveguides tend to be relatively thick, and are fabricated using processes that make it difficult to control the tolerances on the waveguide. Thus, the dielectric waveguides must be machined to insure proper dimensions. Also, when forming a dielectric waveguide coupler wherein the waveguides are brought into close proximity, a slot must be accurately machined between the waveguides with proper dimensions. Thus, it can be seen that such dielectric waveguides and couplers are not amenable to mass production techniques.

OBJECTS OF THE INVENTION

Accordingly, it is an object of the present invention to provide a dielectric waveguide and coupler which is low cost, lightweight, flexible, easy to fabricate and does not require pressurizing.

It is a further object of the present invention to provide a dielectric waveguide and a coupler which are amenable to mass production without significant machining.

It is a further object of the present invention to form a dielectric waveguide and coupler which may be utilized to simplify complex microwave networks.

It is yet a further object of the present invention to provide a dielectric waveguide coupler which provides greater design control over the coupling value thereof.

Other objects, advantages, and novel features of the present invention will become apparent from the detailed description of the invention, which follows the summary.

SUMMARY OF THE INVENTION

Briefly, the above and other objects are realized by a microwave/millimeter wave waveguide coupler comprising a first waveguide formed from a first close grouping of longitudinally running dielectric lines; a second waveguide formed from a second close grouping of longitudinally running dielectric lines; and a coupling region wherein the first and second groupings are in close proximity and wherein at least one line from at least one waveguide grouping crosses over and couples with the other waveguide grouping. The number of line crossovers determines the degree of such a waveguide coupling.

In one embodiment of the present invention, the dielectric lines are realized by dielectric fibers and the close groupings are dielectric fiber bundles. In one form of this embodiment, at least one fiber crosses over from the first waveguide fiber bundle to very close proximity to at least one fiber from the second waveguide fiber bundle and then crosses back to continue as an integral fiber within the first waveguide fiber bundle.

In a second form of this dielectric fiber embodiment, the coupling comprises at least one dielectric fiber from the first waveguide fiber bundle which crosses over to and becomes an integral part of the second waveguide fiber bundle.

In a second embodiment of the present invention, the dielectric lines may be formed by laminated flat dielectric sheets running longitudinally, and the close groupings may then be stacks of laminated flat dielectric sheets.

In one form of this stacked sheet embodiment, the at least one dielectric sheet in the coupling region originates from the first waveguide stack and crosses over to and at least partially overlaps with the second waveguide stack and then crosses back to continue as an integral laminated sheet within the first waveguide stack.

In a second form of this stacked sheet embodiment, the at least one dielectric sheet in the coupling region originates from the first waveguide stack and crosses over to and becomes an integral part of the second waveguide stack.

BRIEF DESCRIPTION OF THE DRAWINGS

FIG. 2(*b*) illustrates the component strips used to form the embodiment of FIG. 2(*a*).

DETAILED DESCRIPTION OF THE PREFERRED EMBODIMENT

Figure 1A:
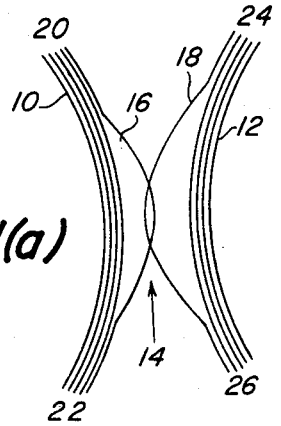
FIGS. 1(*a*)-(*d*) illustrates four forms of a dielectric fiber embodiment of the present invention.
Figure 1B:
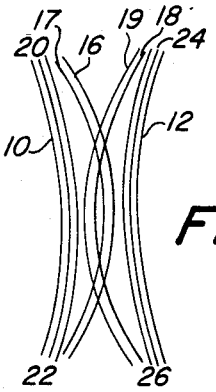
Figure 1C:
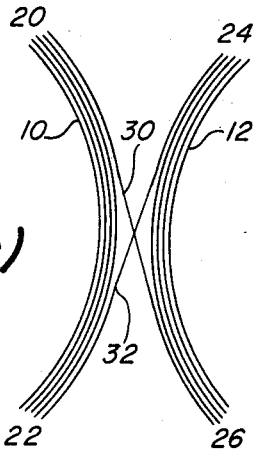
Figure 1D:
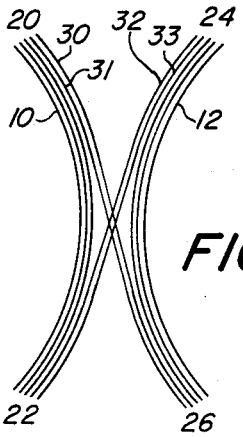

The present invention presents a new class of low cost microwave/millimeter wave dielectric couplers. In one embodiment, the waveguides to be coupled are formed of bundles of dielectric fibers and coupling is achieved by crossing over a certain percentage of the dielectric fibers between waveguide bundles.

In another embodiment of the present invention, the waveguides are formed of stacked longitudinal dielectric lamination sheets and coupling is achieved by crossing over a certain number of the laminate sheets from one waveguide stack to the other waveguide stack.

Referring now to the drawings, FIG. 1(*a*) shows one embodiment of a dielectric line coupler for coupling between a first waveguide 10 and a second waveguide 12. The first waveguide 10 is formed from a first close grouping of longitudinally running dielectric lines while the second waveguide 12 is formed from a second close grouping of longitudinally running dielectric lines. In this embodiment, these dielectric lines are formed by dielectric fibers and the close groupings comprise fiber bundles. Such dielectric fibers ae well known in the art. For example, pure Teflon fibers or fiberglas impregnated with Teflon and filler could be utilized for microwave and millimeter wave transmissions. Other lossier dielectric materials such as Nylon may be utilized at lower microwave frequencies.

These waveguides 10 and 12 are brought into proximity to form a coupling region 14. The coupling is accomplished by taking at least one line from at least one waveguide grouping and crossing it over and coupling that at least one line with the other waveguide grouping. In the embodiment shown in FIG. 1(*a*) utilizing dielectric fibers, at least one dielectric fiber 16 is brought into very close proximity to at least one dielectric fiber 18 from the second waveguide 12. This fiber 16 is then brought back into the first waveguide fiber bundle 10 to continue as an integral fiber there within. The degree of coupling obtained is controlled in two ways. First, the degree of coupling will depend upon the proximity of the fibers 16 and 18. Typically, for a very weak coupling, the spacing between the fibers 16 and 18 should be about 1/10 of a wavelength. The coupling will then increase as this spacing is decreased. The fibers 16 and 18 may also be crossed as shown in FIG. 1(*a*).

The preferred method of controlling the degree of coupling between the waveguides is by controlling the number of fibers crossing over and coupling with fibers from the other waveguide and then crossing back. FIG. 1(*b*) shows a dielectric fiber embodiment where a plurality of fibers 16, 17, 18, and 19 crossover each other and then are brought back to their original waveguide fiber bundles to continue as an integral fibers therewithin. The degree of coupling is controlled by the percentage of the fibers crossing between the waveguide bundles 10 and 12.

Note that for both the embodiments of FIG. 1(*a*) and FIG. 1(*b*) the coupled fibers 16 and 18 in one case and 16–19 in the other case couple all four ports 20, 22, 24, and 26 in this two waveguide coupling configuration. Thus, both of these embodiments are bidirectional couplers.

It should be clear that the coupling achieved between the waveguides shown in FIG. 1(*a*) and FIG. 1(*b*) is obtained via capacitive coupling. In essence, such capacitive coupling occurs because the electromagnetic fields in the waves propagating in the dielectric fibers spread out beyond the material of the fiber. By bringing two dielectric fibers into close proximity, these fields sometimes referred to as surface waves, spread out beyond the fiber material, to couple energy therebetween.

FIG. 1(*c*) and FIG. 1(*d*) show a different coupling form for the dielectric fiber coupling embodiment. Again, a first and second waveguides 10 and 12 which are formed from bundles of dielectric fibers running longitudinally in the direction of the respective waveguides are to be coupled. However, in this case the at least one fiber comprises a dielectric fiber 30 which crosses over from the first waveguide fiber bundle 10 and becomes an integral part of the second waveguide fiber bundle 12. Accordingly, it can be seen that the coupler of FIG. 1(*c*) utilizes direct or feedthrough coupling, as opposed to the capacitive coupling utilized in FIG. 1(*a*) and FIG. 1(*b*).

If only a *single* dielectric fiber 30 is utilized to crossover between the waveguide dielectric fiber bundles 10 and 12, then this coupler constitutes a unidirectional waveguide coupler. This unidirectionality is obtained because only two ports 20 and 26 of the four port two waveguide coupling configuration are involved.

In the configuration actually shown in FIG. 1(*c*), a second dielectric fiber 32 also crosses over from port 24 of the second waveguide fiber bundle to port 22 of the first waveguide fiber bundle 10. In this case, the dielectric fibers 30 and 32 connect port 20 to port 26 and port 24 to port 22 thereby obtaining a bidirectional coupler.

FIG. 1(*d*) illustrates an embodiment with increased bidirectional coupling between the waveguides 10 and 12 obtained by crossing the fibers 30 and 31 from the port 20 to the port 26 and crossing fibers 32 and 33 from the port 24 to the port 22. Thus, it is again clear that the degree of coupling can be controlled by the percentage of fibers crossing between the waveguide fiber bundles. It should also be understood that the embodiment of FIG. 1(*d*) could be changed to a unidirectional coupler from port 20 to port 26 simply by not crossing the dielectric fibers 32 and 33 from the waveguide 12 to the waveguide 10.

Figure 2A:
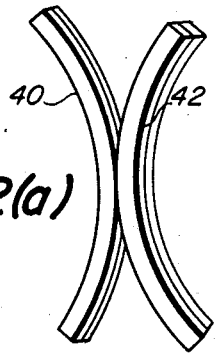
FIG. 2(*a*) illustrates a stacked laminated strip embodiment of the present invention.
Figure 2B:
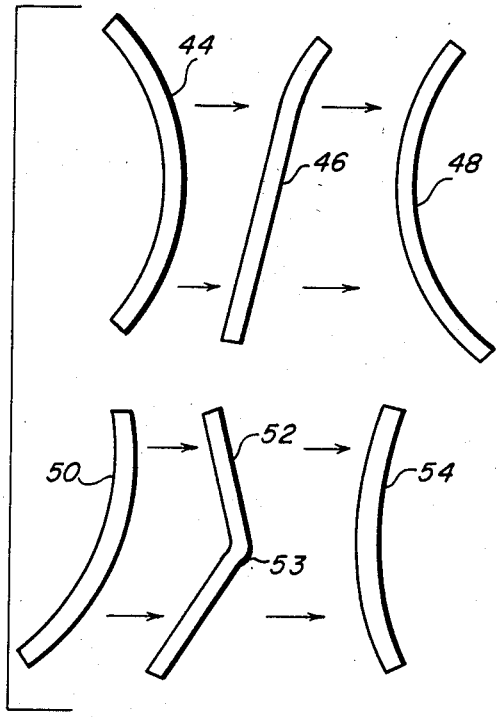

FIG. 2(*a*) discloses a second embodiment of a dielectric coupler. This coupler embodiment utilizes a first waveguide 40 formed from a stack of laminated dielectric sheets, and second waveguide 42, also formed from a stack of laminated dielectric sheets. There are a wide variety of dielectric laminated sheets currently available which may be utilized to implement these waveguide stacks. By way of example, for microwave frequencies, laminated sheets of polyolefin may be utilized. For millimeter wave frequencies, laminated sheets of Teflon, fiberglas impregnated with Teflon and filler, or Duroid made by the Rogers Corporation may be utilized. Regardless of their method of construction, these dielectric laminated sheets will appear homogenous relative to any microwave or millimeter wave energy propagating therethrough.

FIG. 2(*b*) shows a set of laminated dielectric sheets 44, 46, and 48 which may be by way of example, stacked, or disposed in close proximity, in the direction of the arrows in the figure to form the waveguide stacks of FIG. 2(*a*). Utilizing the laminated sheet components 44, 46, and 48, it can be seen that the coupling is obtained by means of the laminated sheet 46 which originates from the first waveguide 44 and then crosses over and becomes an integral part of the second waveguide stack 48. Because of the use of stacking of laminated sheets to form the waveguides 40 and 42, it can be seen that the coupler of FIG. 2(*a*) is a bidirectional coupler. It can also be seen that the degree of coupling between the stacked waveguides 40 and 42 is determined by the number of dielectric sheets which are crossed over from one waveguide stack 40 to the other waveguide stack 42.

In a second form of this stacked laminated sheet coupler, the coupler of FIG. 2(*a*) may be constructed utilizing the dielectric laminated sheet components 50, 52, and 54. Note that the laminate sheets 50 and 54 are very similar to the laminate sheets 44 and 48, respectively. However, the laminate sheet 52 is fabricated to form part of the dielectric waveguide stack 40 but includes a section 53 which at least partially overlaps with the dielectric waveguide stack 54. The amount of this overlap and the number of lamination sheets which overlap can be controlled to determine the degree of coupling of the coupler. In essence, this dielectric sheet 52 originates from the first waveguide stack 50 and crosses over to at least partially overlap with the waveguide stack 54 and then crosses back to continue as an integral laminated sheet within the waveguide stack 50. Again, note that this configuration forms a bidirectional coupler.

It can be seen that in all of the embodiments disclosed above, the degree of coupling can be determined simply by controlling the percentage of the fibers crossing between the waveguide fiber bundles, or by controlling the number of laminated sheets which cross over between the waveguide stacks of laminated sheets.

The foregoing dielectric coupler embodiments are especially amenable to use with dielectric waveguides. However, these dielectric couplers may also be utilized with a variety of standard microwave conductor waveguides simply by using a transition from the standard conductor waveguide to the dielectric waveguide. For example, for a transition between a standard rectangular hollow metallic waveguide to a dielectric waveguide, a horn could be utilized at the end of the rectangular metallic waveguide to provide the conductor taper. In the case of a dielectric waveguide formed from laminated dielectric stacked sheets, the dielectric could be slant cut to provide the dielectric taper. The two tapers are for impedance match enhancement. The slant cut dielectric stack waveguide would be inserted into the hollow rectangular metallic waveguide to a point either within or slightly beyond the horn section of the waveguide. Transition between a rectangular metallic waveguide and a dielectric fiber bundle may be obtained simply by again utilizing an outwardly expanding horn at the end of the hollow metallic waveguide and inserting the waveguide dielectric fiber bundle into the hollow metallic waveguide to a point typically slightly beyond the horn. The end of the dielectric fiber bundle should be slant cut to obtain a taper. It should be noted that the horn as well as the slant cuts for the fiber bundle and the laminated sheet stack can be omitted if broad bandwidth is not required.

It should be noted that the electromagnetic wave propagates in the dielectric material itself, and is not set up between two conductors. Thus, a ground plane is not necessary for such dielectric waveguides. However, it may be convenient to extend the metallic waveguide or stripline to form one or two ground planes, either to support the dielectric, to shield the electromagnetic waves, or to isolate the dielectric lines. However, it is again reiterated that a ground plane is not necessary in the present dielectric waveguide and coupler embodiments, but does provide the advantage of allowing a convenient interface with stripline and other waveguide components.

Figure 3:
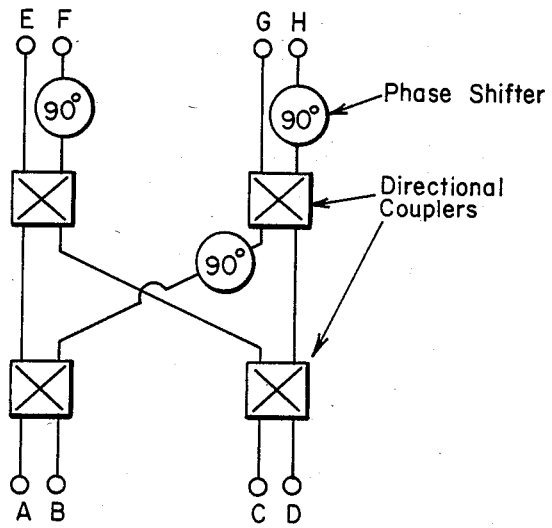
FIG. 3 is a schematic diagram of a Butler Matrix circuit.
Figure 4:
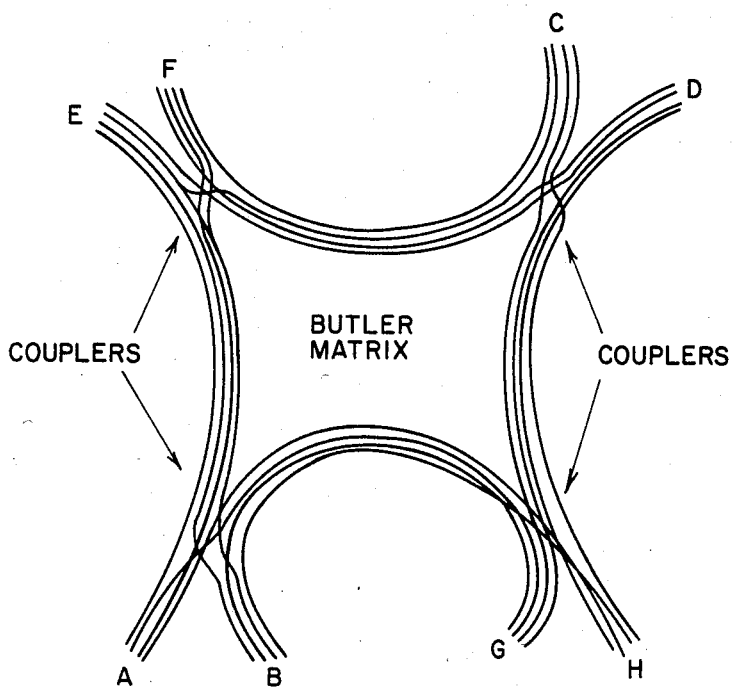
FIG. 4 is a schematic diagram of a Butler Matrix implementation in dielectric fibers.

The present dielectric coupler designs are advantageous not only in their manufacturing simplicity and coupling control function, but also because a variety of signal functions can be combined such as phase shifting, coupling, and phase delay, etc. in a single geometry. The combination of functions is shown to advantage for a Butler Matrix circuit. A standard Butler Matrix circuit is shown in FIG. 3 with its three 90° phase shifters and its four directional couplers. FIG. 4 shows a Butler Matrix formed utilizing dielectric fiber bundles. In the embodiment shown in FIG. 4, the coupling between waveguide fiber bundles is achieved by crossing dielectric fibers from one waveguide over to become an integral part of another waveguide. This embodiment permits the very precise control of the degree of the couplings simply by controlling the number of dielectric fibers crossing over between waveguide fiber bundles. In essence, it can be seen that all that is required to form this Butler Matrix is four fiber bundles with properly routed dielectric fibers to obtain the required couplings. Note that the ends of fibers need not have the same length. In fact, in the case where feeding is required to standard metallic waveguide, if the fibers end with different lengths, they provide a dielectric taper for better bandwidth matching into the waveguide.

Figures 5A, 5B, 5C, 5D, 5E:
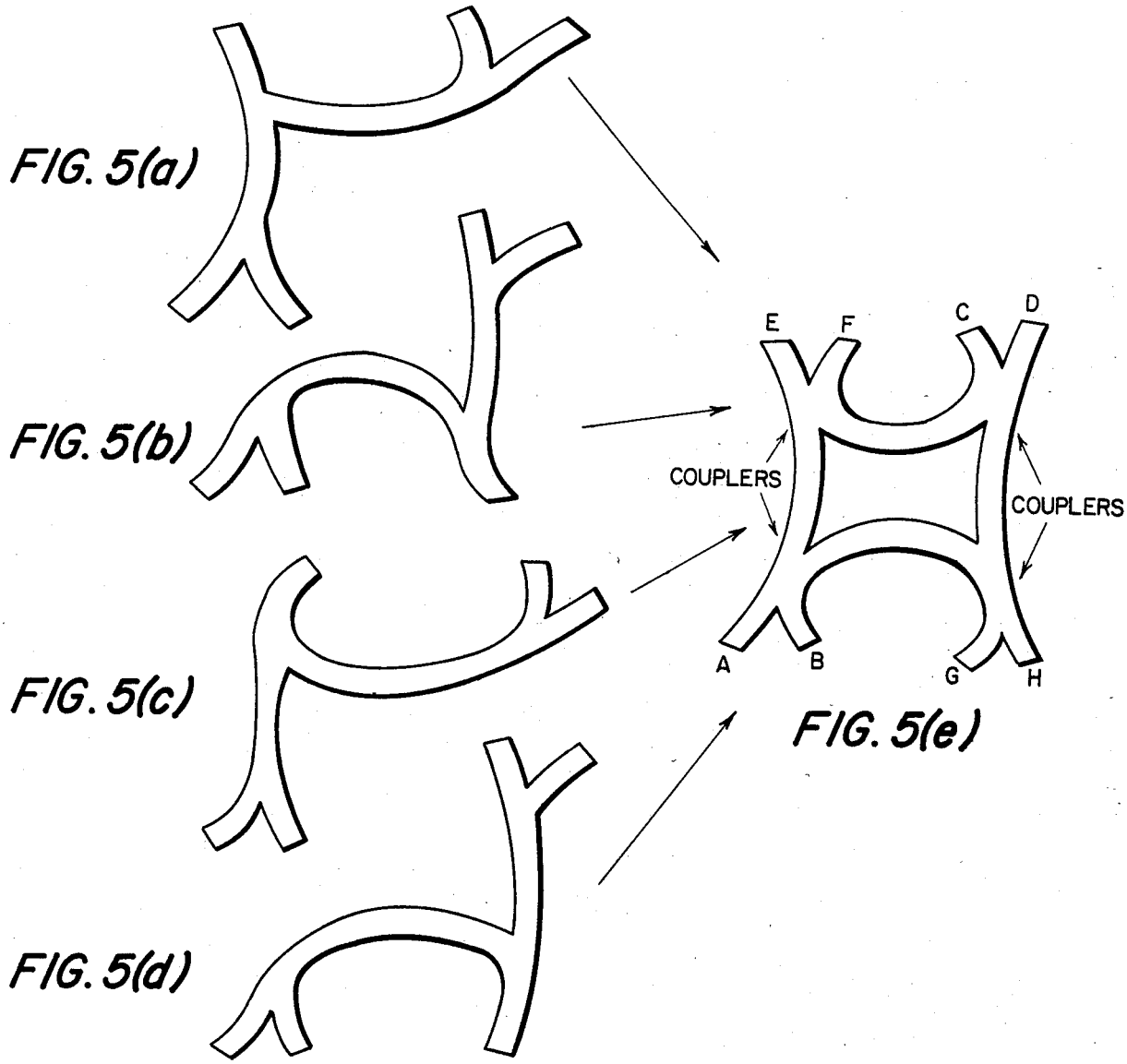
FIGS. 5(*a*)-(*d*) illustrate the component dielectric sheets which are stacked to form the laminated dielectric sheet embodiment of a Butler Matrix as shown in FIG. 5(*e*).

In FIG. 5(*e*), there is shown a dielectric laminated waveguide stack embodiment of the Butler Matrix. The Butler Matrix embodiment of FIG. 5(*e*) is formed by four dielectric laminate sheets shown in FIG. 5(*a*), (*b*), (*c*), and (*d*). It can be seen that by stacking these four dielectric sheets, proper coupling is obtained between all eight ports of the Butler Matrix embodiment of FIG. 5(*e*). If specific power distributions are required, then individual dielectric sheets may be impedance matched by tapering.

It should be noted that this Butler Matrix embodiment formed from stacked dielectric laminated sheets is especially amenable to mass production because the laminated sheets can be cut to a desired pattern either by a knife with a template, or by a laser beam. Then, these sheets can be simply stacked together to form the Butler Matrix. Clearly, this technique can be extended to any device that requires wave coupling, for example, a broadband phase shifter.

It should be noted that with respect to the stacked laminated sheet waveguide configurations, that it is generally desired to dispose the coupling crossover laminated sheets symmetrically within the laminated sheet stack. In one configuration, the crossover coupling sheets can be disposed symmetrically about an imaginary center plane through the waveguide stack. Theoretically, the wave modes propagating through this dielectric laminated sheet stack should have equal field distributions above and below this imaginary center plane.

From the above, it can be seen that a new class of low cost microwave/millimeter wave components has been disclosed in a dielectric medium. the dielectric waveguides and couplers disclosed herein are especially conducive to mass production without any significant machining. The stacked laminated sheet embodiments may be simply stamped out in accordance with a desired pattern and then stacked appropriately. Likewise, the waveguide fiber bundle embodiments can be formed en mass by extrusion. The control over the degree of coupling using the above described embodiments is much more precise than prior art embodiments. These low cost dielectric waveguide and coupler configurations are lightweight, flexible, conformal, radiation hardened, easy to modify, and do not require pressurizing.

It should also be noted that the waveguide fiber bundle and the waveguide laminated sheet stack embodiments are especially conducive to simplifying complex conventional microwave networks as illustrated herein by the Butler Matrix circuit.

Obviously many modifications and variations of the present invention are possible in light of the above teachings. It is therefore to be understood that within the scope of the appended claims the invention may be practiced otherwise than as specifically described.

What is claimed and desired to be secured by Letters Patent of the United States is:

1. A microwave/millimeter wave waveguide coupler comprising:

a first waveguide comprising a first bundle of dielectric microwave/millimeter wave waveguide fibers;

a second waveguide comprising a second bundle of dielectric microwave/millimeter wave waveguide fibers; and a coupling region wherein said first and second fiber bundles are in proximity and wherein at least one fiber from at least one waveguide fiber bundle crosses over and couples with the other waveguide fiber bundle, wherein the number of fiber crossovers determines the strength of the waveguide coupling, wherein said at least one fiber in said coupling region comprises at least one dielectric fiber from said first waveguide fiber bundle which crosses over to and becomes an integral part of said second waveguide fiber bundle.

2. A microwave/millimeter wave waveguide coupler comprising:

a first waveguide comprising a first bundle of dielectric fibers;

a second waveguide comprising a second bundle of dielectric fibers; and a coupling region wherein said first and second fiber bundles are in proximity and wherein at least one fiber from at least one waveguide fiber bundle crosses over and couples with the other waveguide fiber bundle, wherein the number of fiber crossovers determines the strength of the waveguide coupling, wherein said at least one fiber in said coupling region comprises at least two dielectric fibers, wherein one fiber from said at least two dielectric fibers originates in said first waveguide fiber bundle and crosses over to and becomes an integral part of said second waveguide fiber bundle, and a second fiber from said at least two dielectric fibers originates with said second waveguide fiber bundle and crosses over to and becomes an integral part of said first waveguide fiber bundle.

3. A microwave/millimeter wave waveguide coupler comprising:

a first waveguide comprising a first stack of laminated dielectric sheets;

a second waveguide comprising a second stack of laminated dielectric sheets;

a coupling region wherein said first and second stacks of dielectric sheets are in proximity, and wherein at least one dielectric sheet from one of said waveguide stacks crosses over and overlaps at least partially with the other waveguide stack of dielectric sheets, wherein the number of dielectric sheets crossing over and the amount of overlap determines the strength of the waveguide coupling.

4. A waveguide coupler as defined in claim 3, wherein said at least one dielectric sheet in said coupling region originates from said first waveguide stack and crosses over to at least partially overlap with said second waveguide stack and then crosses back to continue as an integral laminated sheet within said first waveguide stack.

5. A waveguide coupler as defined in claim 3, wherein said at least one dielectric sheet in said coupling region originates from said first waveguide stack and crosses over to and becomes an integral part of said second waveguide stack.

6. A waveguide coupler as defined in claim 3, wherein said at least one dielectric sheet in said coupling region comprises at least two dielectric sheets, wherein one sheet from said at least two dielectric sheets originates from said first waveguide stack and crosses over to and becomes an integral part of said second waveguide stack, and the second sheet from said at least two dielectric sheets originates from said second waveguide stack and crosses over to and becomes an integral part of said first waveguide stack.

7. A microwave/millimeter wave waveguide coupler comprising:

a first waveguide formed from a stack of laminated flat dielectric waveguide sheets;

a second waveguide formed from a stack of laminated flat dielectric waveguide sheets; and a coupling region wherein said first and second stacks are in proximity and wherein at least one dielectric sheet from at least one waveguide stack crosses over and couples with the other waveguide stack, wherein the number of dielectric sheet crossovers determines the strength of the waveguide coupling.

8. A waveguide coupler as defined in claim 7, wherein said at least one dielectric sheet in said coupling region originates from said first waveguide stack and crosses over to at least partially overlap with said second waveguide stack and then crosses back to continue as an integral laminated sheet within said first waveguide stack.

9. A waveguide coupler as defined in claim 7, wherein said at least one dielectric sheet in said coupling region originates from said first waveguide stack and crosses over to and becomes an integral part of said second waveguide stack.

10. A method for forming a microwave/millimeter wave waveguide coupler comprising the steps of:

defining a coupling region including a first waveguide input and output ports and a second waveguide input and output ports;

disposing at least one first flat dielectric laminate sheet within said coupling region to connect said first waveguide input and output ports;

disposing at least one second flat dielectric laminate sheet within said coupling region to connect said second waveguide input and output ports; and stacking at least one flat dielectric laminate crossover sheet to overlap said at least one first and second laminate sheets in such a manner as to connect the first waveguide input port to the second waveguide output port, wherein the number of dielectric laminate crossover sheets determines the strength of the coupling.

11. A method as defined in claim 10, wherein said disposing steps and said stacking step each comprise the step of cutting a large dielectric sheet in accordance with a desired pattern to form the desired flat dielectric laminate sheets.

12. A method as defined in claim 11, for achieving a plurality of couplings, wherein said coupling region includes at least an additional third waveguide input and output ports and wherein one or more of said dielectric laminate cutting steps comprises the step of cutting a dielectric sheet in accordance with a desired pattern to form a desired dielectric laminate sheet which may be disposed to connect more than two waveguide ports.

13. A method as defined in claim 10, wherein said stacking step comprises the step of disposing said at least one dielectric laminate crossover sheet to physically overlap the first waveguide input port and to physically overlap the second waveguide output port.

* * * * *